US010001087B2

(12) United States Patent
Hanak

(10) Patent No.: US 10,001,087 B2
(45) Date of Patent: Jun. 19, 2018

(54) EGR POWER MODULE AND METHOD OF USE THEREOF

(71) Applicant: Anthony Stephen Hanak, Mount Holly, NC (US)

(72) Inventor: Anthony Stephen Hanak, Mount Holly, NC (US)

( * ) Notice: Subject to any disclaimer, the term of this patent is extended or adjusted under 35 U.S.C. 154(b) by 276 days.

(21) Appl. No.: 14/662,778

(22) Filed: Mar. 19, 2015

(65) Prior Publication Data

US 2015/0267651 A1 Sep. 24, 2015

Related U.S. Application Data

(60) Provisional application No. 61/955,359, filed on Mar. 19, 2014.

(51) Int. Cl.

| | |
|---|---|
| ***F02M 26/11*** | (2016.01) |
| ***F02M 25/07*** | (2006.01) |
| ***F02M 26/47*** | (2016.01) |
| *F02D 41/00* | (2006.01) |

(52) U.S. Cl.

CPC ..... *F02M 25/0754* (2013.01); *F02M 26/11* (2016.02); *F02M 26/47* (2016.02); *F02D 41/0065* (2013.01); *F02D 2400/11* (2013.01)

(58) Field of Classification Search

CPC .... F02M 26/47; F02M 26/11; F02D 41/0065; F02D 2400/11

See application file for complete search history.

(56) References Cited

U.S. PATENT DOCUMENTS

| | | | | |
|---|---|---|---|---|
| 4,894,630 | A * | 1/1990 | Ueta | H05K 9/0066 174/50.52 |
| 5,026,293 | A * | 6/1991 | Wilson | H01R 13/6658 439/620.22 |
| 5,217,394 | A * | 6/1993 | Ho | H01R 12/62 439/541.5 |
| 5,293,013 | A * | 3/1994 | Takahashi | H01R 29/00 200/51 R |
| 5,321,819 | A * | 6/1994 | Szczepanek | H04L 29/06 709/228 |
| 5,511,994 | A * | 4/1996 | Minich | H01R 13/7195 29/881 |
| 6,146,153 | A * | 11/2000 | Koradia | H01R 12/716 439/638 |
| 6,186,106 | B1 * | 2/2001 | Glovatsky | B60R 16/0215 123/143 C |
| 6,780,060 | B1 * | 8/2004 | Kajiura | G01K 7/42 374/E7.042 |
| 6,830,465 | B2 * | 12/2004 | Norris | H01R 13/518 439/75 |
| 6,928,348 | B1 * | 8/2005 | Lightner | G07C 5/008 701/31.5 |
| 6,948,949 | B1 * | 9/2005 | Schwartz | H01R 9/2491 439/638 |

(Continued)

*Primary Examiner* — Joseph Dallo

(74) *Attorney, Agent, or Firm* — Jeffrey C. Watson; Matthew L. Grell; Grell & Watson Patent Attorneys LLC

(57) ABSTRACT

An exhaust gas recirculation ("EGR") power module configured for a wire harness of an altimetric/barometric pressure sensor of an EGR system for an engine includes a set of wires and a circuit. The set of wires is configured to match the wire harness on the altimetric/barometric pressure sensor for the engine. The circuit provides a resistance to the wire harness through the set of wires.

2 Claims, 4 Drawing Sheets

(56) References Cited

U.S. PATENT DOCUMENTS 6,957,133 B1 * 10/2005 Hunt ..... B60R 25/102 701/32.4
6,984,132 B1 * 1/2006 Spalding ..... H01L 23/04 257/E23.181
6,988,033 B1 * 1/2006 Lowrey ..... G08G 1/20 340/439
7,174,243 B1 * 2/2007 Lightner ..... G08G 1/20 340/989
7,225,065 B1 * 5/2007 Hunt ..... B60R 16/0207 701/33.2
7,228,211 B1 * 6/2007 Lowrey ..... G07C 5/008 701/31.5
7,477,968 B1 * 1/2009 Lowrey ..... G01M 15/04 340/438
7,523,159 B1 * 4/2009 Williams ..... G01M 15/04 701/31.4
7,747,365 B1 * 6/2010 Lowrey ..... G07C 5/006 340/989
7,904,219 B1 * 3/2011 Lowrey ..... G01C 21/26 701/32.3
8,096,813 B2 * 1/2012 Biggs ..... H01R 31/06 439/76.1
8,096,837 B2 * 1/2012 Kan ..... H01R 13/501 439/638
8,904,787 B2 * 12/2014 Styles ..... F02D 9/02 60/605.2
9,520,005 B2 * 12/2016 Banet ..... G07C 5/00
2002/0179025 A1 * 12/2002 Glovatsky ..... F02M 35/10216 123/41.31
2003/0084859 A1 * 5/2003 Glovatsky ..... F02D 41/3005 123/41.31
2007/0107708 A1 * 5/2007 Uchiyama ..... F02M 26/58 123/568.18
2008/0178853 A1 * 7/2008 Yamaoka ..... F02D 41/005 123/568.11
2008/0295590 A1 * 12/2008 Sukegawa ..... G01F 1/688 73/204.26
2009/0143959 A1 * 6/2009 Yamaoka ..... F02D 41/0002 701/108
2011/0146233 A1 * 6/2011 Carlill ..... F01N 3/0235 60/274
2012/0023937 A1 * 2/2012 Styles ..... F02M 26/42 60/605.2
2013/0066536 A1 * 3/2013 Watkins ..... F02B 1/14 701/104
2013/0145830 A1 * 6/2013 Kim ..... F02M 26/49 73/114.74

* cited by examiner

EGR POWER MODULE AND METHOD OF USE THEREOF

CROSS-REFERENCE TO RELATED APPLICATIONS

This application claims benefit to U.S. Provisional Patent Application No. 61/955,359, filed on Mar. 19, 2014, which is incorporated by reference in its entirety.

FEDERALLY SPONSORED RESEARCH OR DEVELOPMENT

None

PARTIES TO A JOINT RESEARCH AGREEMENT

None

REFERENCE TO A SEQUENCE LISTING

None

BACKGROUND OF THE DISCLOSURE

Technical Field of the Disclosure

The disclosure generally relates to internal combustion engines and exhaust gas recirculation ("EGR") systems of such internal combustion engines. More specifically, the disclosure relates to an EGR power module for controlling the EGR systems of internal combustion engines and methods of use thereof.

Description of the Related Art

In internal combustion engines, exhaust gas recirculation ("EGR") is a process where nitrogen oxide (NOx) emissions is reduced and is used in both standard gasoline and diesel engines. NOx is produced in a narrow band of high cylinder temperatures and pressures. EGR systems work by recirculating some of the engine's exhaust back to the engine cylinders. Exhaust is moved back into the combustion chamber when the exhausted air is much hotter than the intake air. EGR systems work by diluting the N2 and providing gases inert to combustion (CO2 primarily) to act as an absorbent of combustion heat to reduce peak in cylinder temperatures.

In an EGR system for a diesel engine, the exhaust gas replaces some of the excess oxygen in the pre-combustion mixture. Because NOx forms primarily when a mixture of nitrogen and oxygen is subjected to high temperature, the lower combustion chamber temperatures caused by EGR may reduce the amount of NOx the combustion generates, which consequently causes some loss of engine efficiency.

Most modern engines now require EGR to meet emissions standards. However, EGRs appear to be a very expensive technology over the long haul for reducing NOx emissions. In modern diesel engines, the EGR gas is cooled with a heat exchanger to allow the introduction of a greater mass of recirculated gas. Unlike standard gasoline or spark-ignition engine ("SI" engines), diesels are not limited by the need for a contiguous flame front. Furthermore, since diesels always operate with excess air, they use EGR rates as high as 50%. For example, at idle when there is otherwise a large excess of air in controlling NOx emissions, it has been discovered that exhaust recirculated back into the cylinder can increase engine wear as carbon particulate wash past the rings and into the oil.

Since diesel engines are unthrottled, it has been discovered that EGR does not lower throttling losses in the way that it does for SI engines. Exhaust gas, largely carbon dioxide and water vapor, has a higher specific heat than air, so it still serves to lower peak combustion temperatures. However, it has been discovered that adding EGR to a diesel reduces the specific heat ratio of the combustion gases in the stroke of the engine, i.e. the power stroke. This reduces the amount of power that can be extracted by the piston. EGR also tends to reduce the amount of fuel burned in the power stroke. This is evident by the increase in particulate emissions that corresponds to an increase in EGR.

Particulate matter (mainly carbon) that is not burned in the power stroke is wasted energy. Stricter regulations on particulate matter ("PM") have called for further emission controls to be introduced to compensate for the PM emissions introduced by EGR. The most common is a diesel particulate filter in the exhaust system which cleans the exhaust but reduces fuel efficiency. Since EGR increases the amount of PM that must be dealt with and reduces the exhaust gas temperatures and available oxygen, these filters need to function properly to burn off soot. Automakers inject fuel and air directly into the exhaust system to keep these PM filters from becoming blocked up.

By feeding the lower oxygen exhaust gas into the intake, it has been discovered that diesel EGR systems lower combustion temperature, reducing emissions of NOx. This makes combustion less efficient, compromising economy and power. The normally "dry" intake system of a diesel engine is now subject to fouling from soot. Unburned fuel and oil in the EGR bleed, which has little effect on airflow, when combined with oil vapor from a Crankcase ventilation system (PCV system), can cause buildup of sticky tar in the intake manifold and valves. It has also been discovered to cause problems with components such as swirl flaps, where fitted.

EGR systems have also been discovered to add abrasive contaminants and increase engine oil acidity, which in turn can reduce engine longevity.

Though engine manufacturers have refused to release details of the effect of EGR on fuel economy, it has been calculated that the EPA regulations of 2002 that led to the introduction of cooled EGR were associated with a 3% drop in engine efficiency, bucking a trend of a 0.5% a year increase. Poor EGR performance occurs often, with hesitation, smoking, coughing, backfiring, and poor fuel mileage. Currently, devices only remove the EGR system, which is illegal unless used in an off road situation.

In sum, it has been discovered that EGR can be a disadvantage to engine efficiency through: 1) shortened engine lubricant life; 2) increased carbon/soot deposits throughout the engine; 3) reduced engine performance; 4) reduced fuel economy; 5) increased emissions; 6) both minor and catastrophic power train component/engine failure/reduced engine/equipment life; 7) damaged emission controls IE, EGR, turbo, diesel particulate filter; 8) cost of time, expense and inconvenience to the operator/end user; the like; and/or combinations thereof. Depending on the use of the vehicle, it has been discovered that these problems can crop up in a very short time and even in ideal conditions they may still develop. It is quite evident that, prior to the instant disclosure, researchers may be still trying to identify cause and effect of the EGR system and clearly have no solution to the problem.

As can be seen, there is a need for a solution to required EGR systems that is legal and works with the computer/ECM that controls the EGR system without having to remove the EGR system or modify the system.

Therefore, it is readily apparent that there is a recognizable unmet need for device that controls the EGR system for improved efficiency and/or life of the engine without having to remove and/or modify the EGR system.

The instant disclosure of an EGR Power Module and method of use thereof is designed to address at least some aspects of the problems discussed above.

SUMMARY

Briefly described, in a possibly preferred embodiment, the present apparatus overcomes the above-mentioned disadvantages and meets the recognized need for such a device by providing an exhaust gas recirculation ("EGR") power module for controlling the EGR system of an engine for improved engine efficiency without having to remove and/or modify the EGR system. The EGR power module may be configured for the wire harness for the altimetric/barometric pressure sensor of the EGR system. The EGR power module may generally include a set of wires and a circuit. The set of wires may match the wire harness on the altimetric/barometric pressure sensor for the engine. The circuit may provide a resistance and/or a steady electrical current flow to the wire harness through the set of wires.

One feature may be a male plug disposed at the end of set of wires configured to match the female plug of the wire harness of the altimetric/barometric pressure sensor.

One feature may be that the EGR power module may be for a 2002 through 2006 Detroit Diesel 12.7 and/or 14.0 liter engine, or the like. In select embodiments, the EGR power module may maintain the EGR system between 5% to 15%. In possibly preferred embodiment, the EGR power module may maintain the EGR system at between 7% to 10%. In a possibly most preferred embodiment, the EGR power module may maintain the EGR system at approximately or equal to 7%. In select embodiments, the EGR power module may provide a resistance of 4.0 to 5.5 ohms. In possibly preferred embodiments, the EGR power module may provide a resistance of between 4.6 to 5.0 ohms. In a possibly most preferred embodiment, the EGR power module may provide a resistant of approximately or equal to 4.8 ohms. In other select embodiments, the steady electrical current flow may be approximately 2.5 volts.

One feature may be that the circuit includes at least one electrical component. In select embodiments, the electrical components may include, but are not limited to, at least one resistor, at least one capacitor, the like, and/or combinations thereof.

In select embodiments, the circuit may include at least two electrical components, including at least two of the electrical components interconnected in series. In select embodiments, the electrical components connected in series may be resistors. The resistors may be configured to provide 4.0 to 5.5 ohms, possibly preferably between 4.6 to 5.0 ohms, and possibly most preferably approximately or equal to 4.8 ohms. As examples, each resistor can carry 5 volts, whereby when connected in series may provide the steady electrical current flow of approximately 2.5 volts. As examples, each resistor may be, but are clearly not limited thereto, a 10 k ohm ½ watt resistor.

Another feature may be a pc board for holding the circuit and connecting the electrical components thereof.

Another feature may be that the EGR power module may be weatherproofed. As examples, the circuit may be covered in epoxy, and/or the set of wires and/or male plug may include heat shrink tubing. In select embodiments, the heat shrink tubing, and/or the circuit, may be dipped in a multipurpose rubber coating.

Another feature may be the inclusion of tab connectors attached to the ends of the set of wires, including an input wire, a first output wire, and a second output wire. In select embodiments, additional heat shrink tubing may be attached to the tab connectors.

The circuit for the EGR power module may generally include the input wire, the first output wire, the second output wire, and at least one of the electrical components interconnecting the input wire with the first and second output wires. The at least one electrical component may provide a resistance and/or a steady electrical current flow from the input wire to each of the first and second output wires. In select embodiments, the circuit may provide a resistance of 4.0 to 5.5 ohms to each of the first and second output wires. In possibly preferred embodiments, the circuit may provide a resistance of between 4.6 to 5.0 ohms to each of the first and second output wires. In a possibly most preferred embodiment, circuit may provide a resistant of approximately or equal to 4.8 ohms to each of the first and second output wires. In select embodiments, the steady electrical current flow to each of the first and second output wires may be approximately 2.5 volts.

In select embodiments of the circuit of the EGR power module, the electrical component can include at least one resistor, at least one capacitor, the like, and/or combinations thereof.

In select embodiments of the circuit for the EGR power module, the circuit may include at least two electrical components interconnecting the input wire with the first and second output wires. In select embodiments, at least one right electrical component may interconnect the input wire with the first output wire, and at least one left electrical component may interconnect the input wire with the second output wire. In select embodiments, two left electrical components may be interconnected in series between the input wire and the first output wire, and/or two right electrical components may be interconnected in series between the input wire and the second output wire.

In select embodiments of the circuit for the EGR power module, each of the two left electrical components and the two right electrical components may be resistors. The resistors may be configured to provide 4.0 to 5.5 ohms, possibly preferably between 4.6 to 5.0 ohms, and possibly most preferably approximately or equal to 4.8 ohms. As examples, each resistor can carry 5 volts, whereby when connected in series may provide the steady electrical current flow of approximately 2.5 volts. As examples, each resistor may be, but are clearly not limited thereto, a 10 k ohm ½ watt resistors.

One feature of the circuit may be the inclusion of a pc board between the input wire and the first and second output wires for holding the electrical components.

Another feature may be that the circuit can be weatherproofed. As examples, the electrical components may be covered in epoxy on the pc board, and/or the input wire and the first and second output wires may include heat shrink tubing. In select embodiments, the heat shrink tubing covering the wires, the pc board, and the plurality of electrical components may be dipped in a multipurpose rubber coating.

In select embodiments of the circuit, the input wire may be red, the first output wire may be black, and/or the second output wire may be white, green, or the like.

Another feature of the circuit may be the inclusion of tab connectors that may be attached to the ends of the input wire, the first output wire, and/or the second output wire. In select embodiments, additional heat shrink tubing may be attached to the tab connectors.

Another feature of the circuit may be a potting box.

Yet another feature may be the inclusion of a male plug matching the female end in the wire harness on an altimetric/barometric pressure sensor for an EGR system of an engine. In select embodiments, the engine may be a 2002 through 2006 Detroit Diesel 12.7 and/or 14.0 liter engine.

In use, a method of controlling an EGR system for improved efficiency and/or life of an engine may be carried out utilizing any of the various embodiments of the EGR power module as shown and/or described herein. The method may generally include the steps of: providing the EGR power module configured for the wire harness of an altimetric/barometric pressure sensor of the EGR system in any of the various embodiments shown and/or described herein; removing the altimetric/barometric pressure sensor; installing the provided EGR power module on the wire harness of the altimetric/barometric pressure sensor of the EGR system; and controlling the EGR system with the EGR power module.

One feature of the method of controlling an EGR system for improved efficiency of an engine as disclosed herein is the method may be carried out without the steps of removing the EGR system and/or modifying the EGR system.

In select embodiments, the step of controlling the EGR system with the EGR power module may include maintaining the EGR system at a desired load including providing a resistance and/or a steady electrical current flow to the wire harness of the altimetric/barometric pressure sensor of the EGR system based on the desired load. For example, and clearly not limited thereto, the desired load may be between 5% to 15%, possibly preferably between 7% and 10%, and possibly most preferably approximately or equal to 7%. As another examples, and clearly not limited thereto, the resistance may be between 2.5 to 4.0 ohms, possibly preferably between 4.6 to 5.0 ohms, and possibly most preferably approximately or equal to 4.8 ohms. As another examples, and clearly not limited thereto, the steady electrical current flow may be approximately 2.5 volts.

In select embodiments, the step of removing the altimetric/barometric pressure sensor may include the steps of: locating the altimetric/barometric pressure sensor on the engine; and unplugging the altimetric/barometric pressure sensor from its wire harness.

In select embodiments, the step of installing the EGR power module on the wire harness of the altimetric/barometric pressure sensor of the EGR system may include the step of plugging the EGR power module into the wire harness of the altimetric/barometric pressure sensor.

In other various select embodiments, the method of controlling an EGR system for improved efficiency of an engine may further include the steps of: storing the altimetric/barometric pressure sensor in a safe place; starting the engine; looking to see that no check engine lights are on; checking that the cross over pipe remains cool to touch; checking the actuator rod that controls the variable nozzle turbocharger ("VNT") on turbo is going to top at stop screw; the like, and/or combinations thereof.

One feature of the method of controlling an EGR system for improved efficiency of an engine may be that the method can be carried out on a 2002 through 2006 Detroit Diesel 12.7 and/or 14.0 liter engine.

BRIEF DESCRIPTION OF THE DRAWINGS

The present EGR power module and method of use thereof will be better understood by reading the Detailed Description with reference to the accompanying drawings, which are not necessarily drawn to scale, and in which like reference numerals denote similar structure and refer to like elements throughout, and in which.

Figure 1:
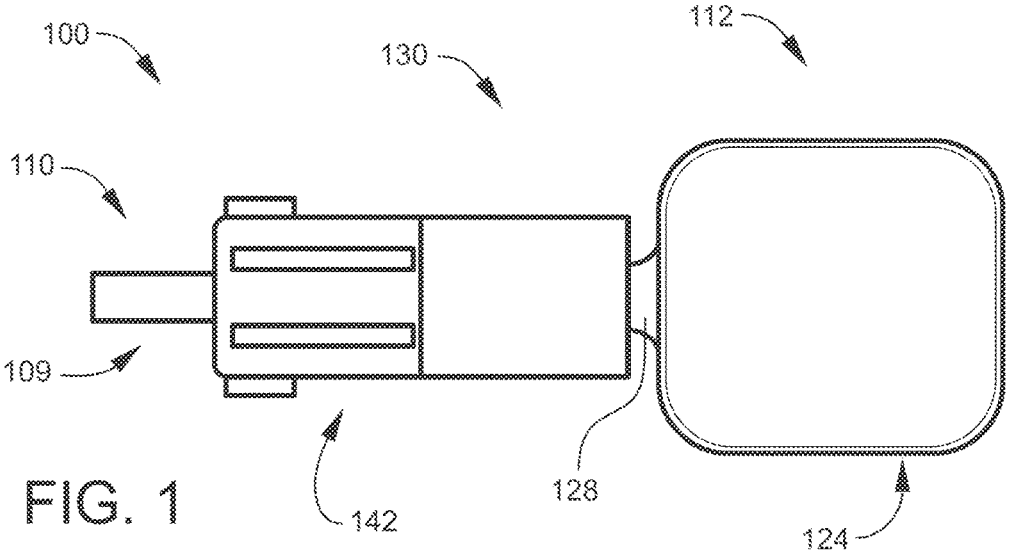
FIG. 1 is a top view of an exemplary embodiment of the EGR module according to the instant disclosure.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

In describing the exemplary embodiments of the present disclosure, as illustrated in FIGS. 1-6, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Referring now to FIGS. 1-5 by way of example, and not limitation, therein is illustrated example embodiments of exhaust gas recirculation ("EGR") power module 100. EGR power module 100 may be for controlling EGR system 106 of engine 108 for improved efficiency and/or life of engine 108 without having to remove and/or modify EGR system 106. EGR power module 100 may be configured for wire harness 102 of altimetric/barometric pressure sensor 104 of EGR system 106. EGR power module 100 may generally include set of wires 109 and circuit 112. Set of wires 109 may match wire harness 102 on altimetric/barometric pressure sensor 104 for engine 108. Circuit 112 may provide resistance 114 to wire harness 102 through set of wires 109. Circuit 112 may also provide a steady electrical current flow to wire harness 102 through set of wires 109.

Male plug 110 may be included with EGR power module 100. See FIG. 1. Male plug 110 may be for making installation of EGR power module 100 easier and require less time. However, the invention is not limited to use with male plug 110, as male plug 110 is not required and set of wires 109 may be spliced or otherwise connected to wire harness 102 of altimetric/barometric pressure sensor 104. Male plug 110 may be disposed at the end of set of wires 109. Male plug 110 may be configured to match the female plug (not shown) of wire harness 102 of altimetric/barometric pressure sensor 104.

In select embodiments, EGR power module 100 may be for use on a 2002 through 2006 Detroit Diesel 12.7 and/or 14.0 liter engine, or the like. In select embodiments, EGR power module 100 may maintain EGR system 106 between 5% to 15%. In possibly preferred embodiment, EGR power module 100 may maintain EGR system 106 at between 7% to 10%. In a possibly most preferred embodiment, EGR power module 100 may maintain EGR system 106 at approximately or equal to 7%. In select embodiments, EGR power module 100 may provide resistance 114 of 4.0 to 5.5 ohms. In possibly preferred embodiments, EGR power module 100 may provide resistance 114 of between 4.6 to 5.0 ohms. In a possibly most preferred embodiment, EGR power module 100 may provide resistant 114 of approximately or equal to 4.8 ohms. In other select embodiments, EGR power module 100 may provide steady electrical current flow of approximately 2.5 volts For example, when EGR power module 100 may be for use on a 2002 through 2006 Detroit Diesel 12.7 and/or 14.0 liter engine, or the like, EGR power module 100 providing resistance 114 of approximately 4.8 ohms and a current flow of approximately 2.5 volts may maintain EGR system 106 of the 2002 through 2006 Detroit Diesel 12.7 and/or 14.0 liter engine at approximately 7%. This desired load of EGR system 106 being 7 percent has been discovered to maximize engine efficiency and improve engine life. However, the invention is not so limited, and any desired load may be maintained with EGR power module 100 by providing the desired resistance 114 and/or current flow. Resistance 114 may be steady and/or it may be designed to vary if desired. The current flow may likewise be steady and/or it may be designed to vary if desired.

At least one electrical component 116 may be included in circuit 112 of EGR power module 100. See FIGS. 2-3. Electrical component 116 or a plurality of electrical components 116 may be for providing resistance 114 and/or steady state current flow through set of wires 109. Electrical component 116 or the plurality of electrical components 116 may be any desired number, type, and or configuration of electrical components for providing resistance 114 through set of wires 109. In select embodiments, electrical components 116 may include, but are not limited to, at least one resistor 118, at least one capacitor 122, the like, and/or combinations thereof. In select embodiments, circuit 112 may include at least two electrical components 116, including, but not limited to, at least two of the electrical components interconnected in series, as shown in FIG. 3.

Resistors 118 may be included in circuit 112 of EGR power module 100 as some or all of the electrical components 116. See FIGS. 2-3. In select embodiments, resistors 118 may be connected in series, like two (2) resistors 118 resistors connected in series between input wire 134 and first output wire 136 and second output wire 138. The combination of resistors 118 may provide resistance 114 of 4.0 to 5.5 ohms to each first output wire 136 and second output wire 138, possibly between 4.6 to 5.0 ohms to each first output wire 136 and second output wire 138, or even possibly approximately or equal to 4.8 ohms to each first output wire 136 and second output wire 138. As examples, each resistor 118 can carry 5 volts, whereby when connected in series may provide steady electrical current flow of approximately 2.5 volts. Each resistor may be any desired size resistor, including, but not limited thereto, 10 k ohm ½ watt resistor 120. As an example, and clearly not limited thereto, two (2) 10 k ½ ohm watt resistor 120 has been discovered to work when connected in series between input wire 134 and first output wire 136 and second output wire 138 to provide resistance 114 of 4.8 ohms and the steady electrical current flow of approximately 2.5 volts.

PC board 124 may be included with circuit 112 of EGR power module 100. See FIGS. 1-4. PC board 124 may be for holding or housing circuit 112 and connecting electrical components 116. PC board 124 may include protrusions and/or soldering points for connecting electrical components 116.

One feature of EGR power module 100 may be that it can be weatherproofed. Weatherproofed, as used herein, may refer to a means or process or device or plurality of devices for providing resistance to the elements, like weather, dust, corrosion, etc. As examples, circuit 112 may be covered in epoxy 126, and/or set of wires 109 and/or male plug 110 may include heat shrink tubing 128. In select embodiments, heat shrink tubing 128, and/or circuit 112, including pc board 124, may be dipped in multipurpose rubber coating 130. Another weatherproofing feature may be the inclusion of potting box 142 for set of wires 109 and tab connectors 132 inside male plug 110.

Tab connectors 132 may be included with set of wires 109 in EGR power module 100. See FIGS. 2-3. Tab connectors 132 may be for connecting set of wires 109 to other wires, like wire harness 102 of altimetric/barometric pressure sensor 104. Tab connectors 132 may be attached to the ends of set of wires 109, including to the end of input wire 134, the end of first output wire 136, and the end of second output wire 138. In select embodiments, additional heat shrink tubing 140 may be attached to or around tab connectors 132, like for sealing and/or weatherproofing the connections.

Figure 2:
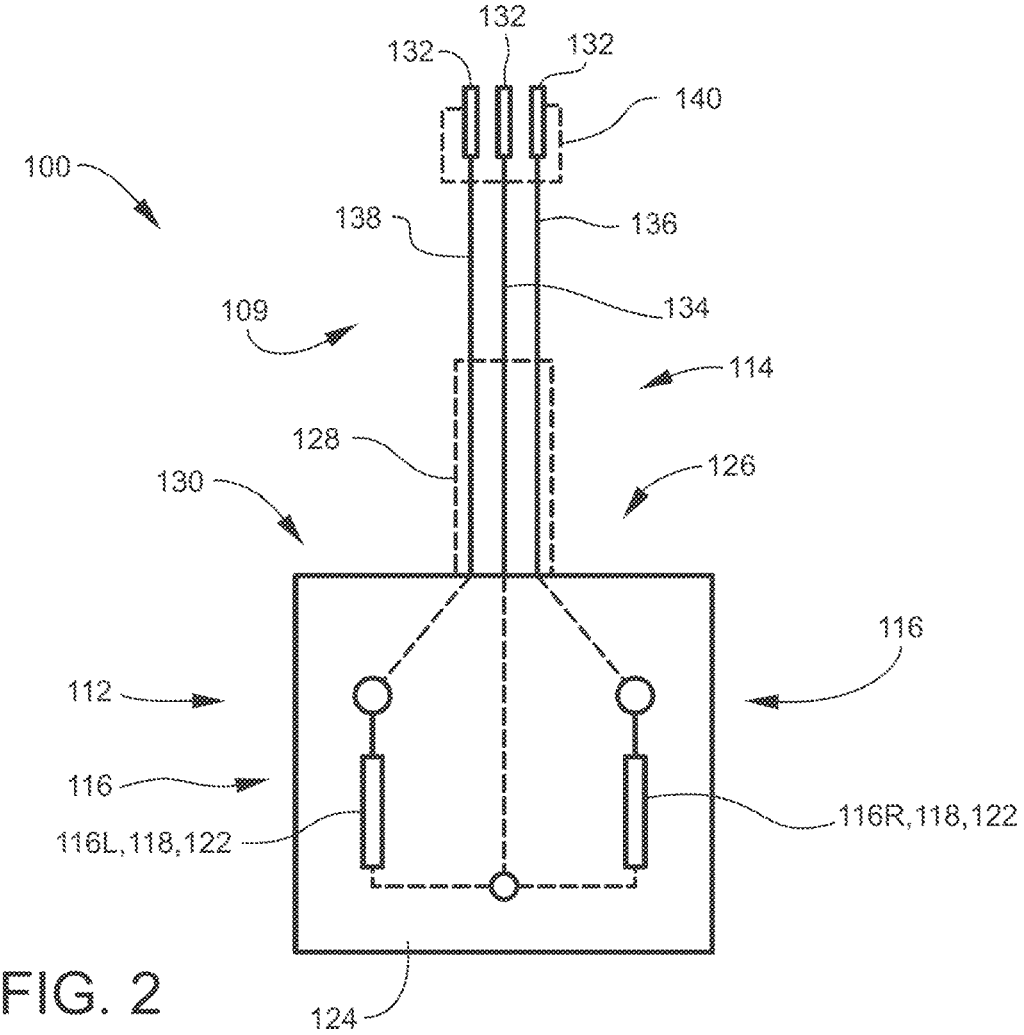
FIG. 2 is a top view of a schematic diagram of an exemplary embodiment of the EGR module according to the instant disclosure.
Figure 3:
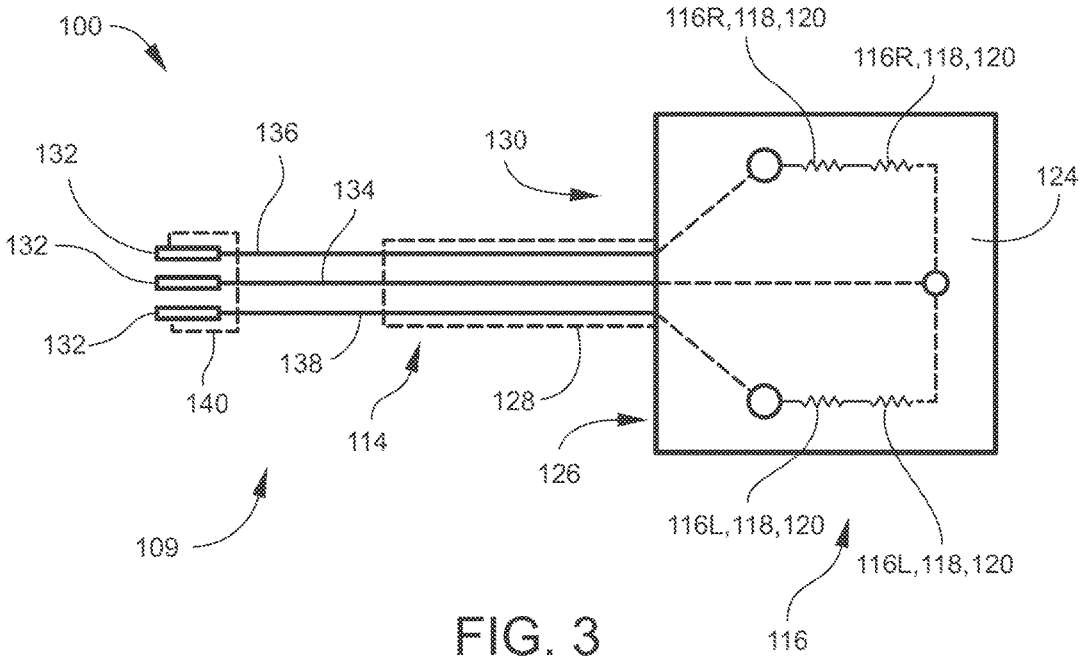
FIG. 3 is a bottom view of the EGR from FIG. 2.

Referring to FIGS. 2-3, example embodiments of circuit 112 for EGR power module 100 are shown. Circuit 112 may generally include input wire 134, first output wire 136, second output wire 138, and at least one of the electrical components 116 interconnecting input wire 134 with first and second output wires 136 and 138. The at least one electrical component 116 may provide resistance 114 and/or steady electrical current flow from input wire 134 to each of first and second output wires 136 and 138. Electrical components 116 or a plurality of electrical components 116 may be configured in circuit 112 in any desired manner as discussed above, including, but not limited to, at least one resistor 118, at least one capacitor 122, the like, and/or combinations thereof. Referring to the exemplary embodiment of FIG. 2

In select embodiments of circuit 112 for EGR power module 100, circuit 112 may include at least two electrical components 116 interconnecting input wire 134 with first and second output wires 136 and 138. Referring to the exemplary embodiments of FIG. 2, in select embodiments, at least one right electrical component 116R may interconnect input wire 134 with first output wire 136, and at least one left electrical component 116L may interconnect input wire 134 with second output wire 138. Referring to the exemplary embodiments of FIG. 3, in select embodiments, two left electrical components 116L may be interconnected in series between input wire 134 and first output wire 136, and/or two right electrical components 116R may be interconnected in series between input wire 134 and second output wire 138.

In select embodiments of circuit 112 for EGR power module 100, each of the two left electrical components 116L and the two right electrical components 116R may be resistors 118. See FIG. 3. As an example, the combination of resistors 118 may provide resistance 114 of 4.0 to 5.5 ohms to each first output wire 136 and second output wire 138, possibly between 4.6 to 5.0 ohms to each first output wire 136 and second output wire 138, or even possibly approximately or equal to 4.8 ohms to each first output wire 136 and second output wire 138. As examples, each resistor 118 can carry 5 volts, whereby when connected in series may provide steady electrical current flow of approximately 2.5 volts. As examples, each resistor may be, but are clearly not limited thereto, 10 k ohm ½ watt resistors 120.

In select embodiments of circuit 112, input wire 134 may be red, first output wire 136 may be black, and/or second output wire 138 may be white, green, or the like. This red, black and white/green color configuration may be designed to match wire harness 102 of altimetric/barometric pressure sensor 104.

Figure 5:
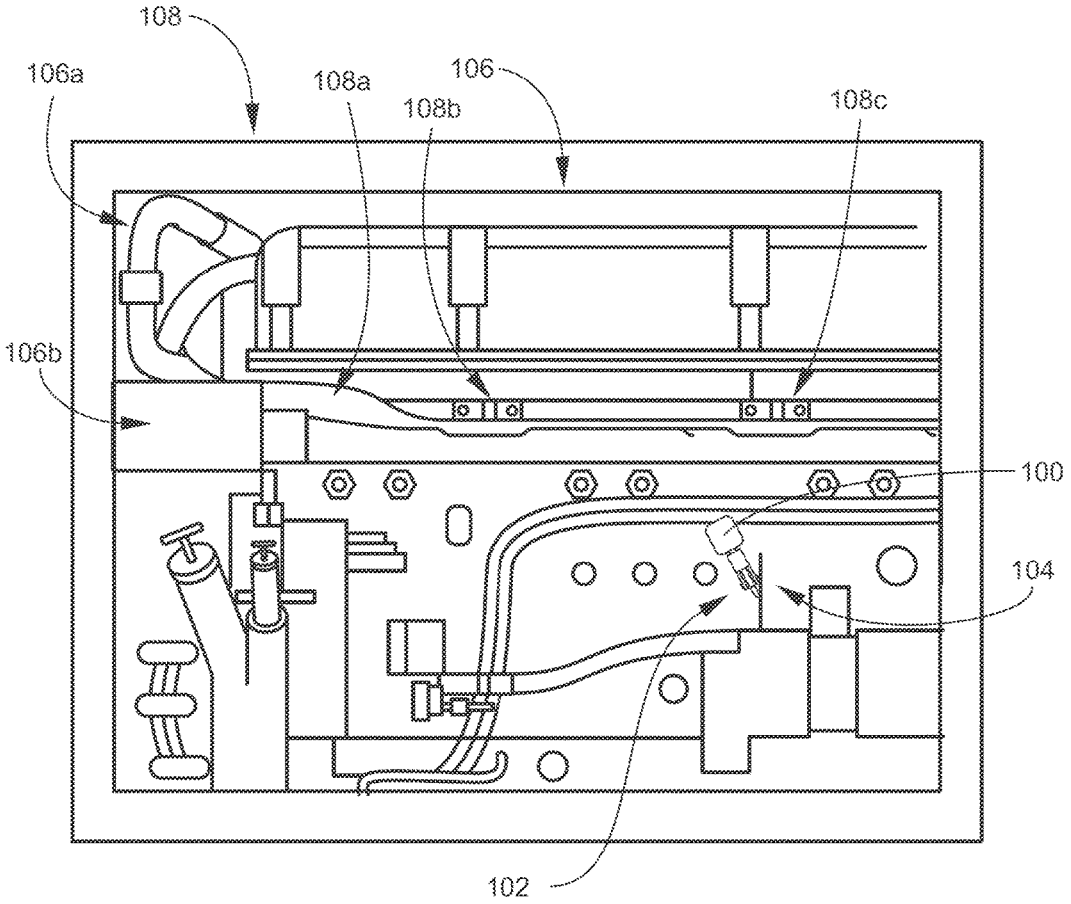
FIG. 5 is a diagram of an exemplary engine with an exemplary EGR system with an exemplary EGR power module installed thereon according to the instant disclosure.

Referring now to FIG. 5, a diagram of exemplary engine 108 with exemplary EGR system 106 with exemplary EGR power module 100 installed thereon is shown. In this diagram, certain locations and parts are shown, namely: the location of EGR gas deliver pipe 106*a*, the location of EGR mixer 106*b*, the location of intake manifold 108*a*, the location of intake manifold air temperature sensor 108*b*, the location of intake manifold boost pressure sensor 108*c*, and the location of altimetric/barometric pressure sensor 104 and its wire harness 102. These locations and parts may be useful for locating wire harness 102 of altimetric/barometric pressure sensor 104 and installing EGR power module 100 on wire harness 102 of altimetric/barometric pressure sensor 104. This diagram shown in FIG. 5 may refer schematically to a 2002 through 2006 Detroit Diesel 12.7 and/or 14.0 liter engine.

Figure 6:
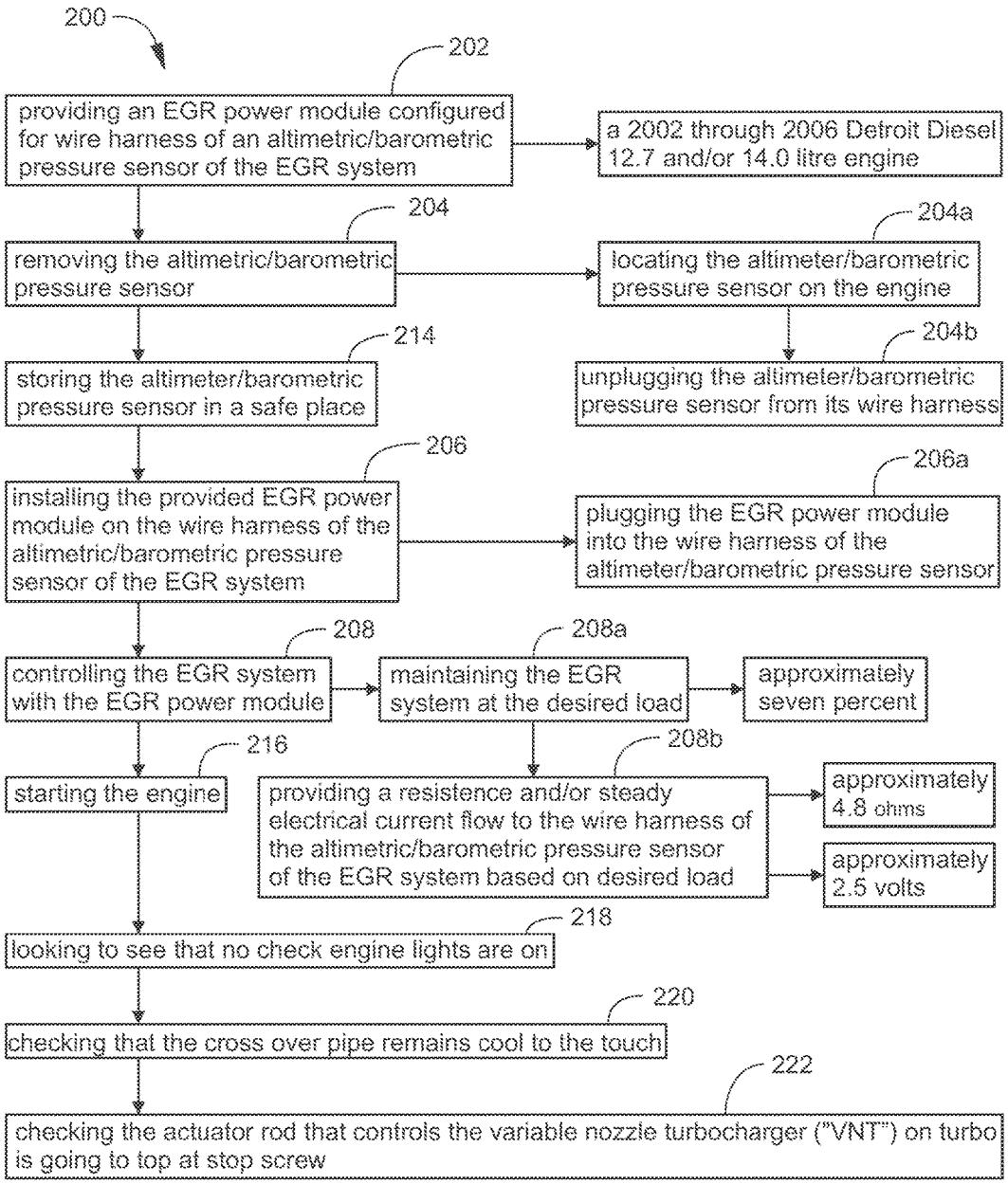
FIG. 6 is a flow chart of an exemplary embodiment of the method of controlling an EGR system of an engine for improving the efficiency and/or life of the engine according to the instant disclosure.

Referring now to FIG. 6, method 200 of controlling EGR system 106 for improved efficiency and/or life of engine 108 is shown. Method 200 may be carried out utilizing any of the various embodiments of EGR power module 100 as shown and/or described herein. Method 200 may generally include the steps of: step 202 of providing EGR power module 100 configured for wire harness 102 of altimetric/barometric pressure sensor 104 of EGR system 106 in any of the various embodiments shown and/or described herein; step 204 of removing altimetric/barometric pressure sensor 104; step 206 of installing the provided EGR power module 100 on wire harness 102 of altimetric/barometric pressure sensor 104 of EGR system 106; and step 208 of controlling EGR system 106 with EGR power module 100.

One feature of method 200 of controlling EGR system 106 for improved efficiency and/or life of engine 108 as disclosed herein is method 200 may be carried out without the steps of removing EGR system 106 and/or modifying EGR system 106.

In select embodiments of method 200 of controlling EGR system 106 for improved efficiency and/or life of engine 108, step 208 of controlling EGR system 106 with EGR power module 100 may include maintaining EGR system 106 at a desired load including providing resistance 114 and/or steady electrical current flow to wire harness 102 of altimetric/barometric pressure sensor 104 of EGR system 106 based on the desired load. For example, and clearly not limited thereto, the desired load may be approximately or equal to 7%. As another example, and clearly not limited thereto, resistance 114 may be approximately or equal to 4.8 ohms and/or steady electrical current flow may be maintained at approximately 2.5 volts.

In select embodiments of method 200 of controlling EGR system 106 for improved efficiency and/or life of engine 108, step 204 of removing altimetric/barometric pressure sensor 104 may include the steps of: step 204*a* of locating altimetric/barometric pressure sensor 104 on engine 108; and step 204*b* of unplugging altimetric/barometric pressure sensor 104 from its wire harness 102.

In select embodiments of method 200 of controlling EGR system 106 for improved efficiency and/or life of engine 108, step 206 of installing EGR power module 100 on wire harness 102 of altimetric/barometric pressure sensor 104 of EGR system 106 may include step 206*a* of plugging EGR power module 100 into wire harness 102 of altimetric/barometric pressure sensor 104.

In other various select embodiments, method 200 of controlling EGR system 106 for improved efficiency and/or life of engine 108 may further include the steps of: step 214 of storing altimetric/barometric pressure sensor 104 in a safe place; step 216 of starting engine 108; step 218 of looking to see that no check engine lights are on; step 220 of checking that the cross over pipe remains cool to touch; step 222 of checking the actuator rod that controls the variable nozzle turbocharger ("VNT") on turbo is going to top at stop screw; the like, and/or combinations thereof.

One feature of method 200 of controlling EGR system 106 for improved efficiency and/or life of engine 108 may be that method 200 can be carried out on a 2002 through 2006 Detroit Diesel 12.7 and/or 14.0 liter engine.

EXAMPLES

Referring to FIGS. 1-3, an embodiment of the present disclosure of EGR power module 100 was created with perforated pc board 124 covered in epoxy 126. A plurality of resistors 118 were attached to pc board 124. Set of wires 109 were connected to the center of the plurality of resistors and to the end of each resistor. Heat shrink tubing 128 covers set of wires 109. All components were dipped in multipurpose rubber coating 130.

Figure 4:
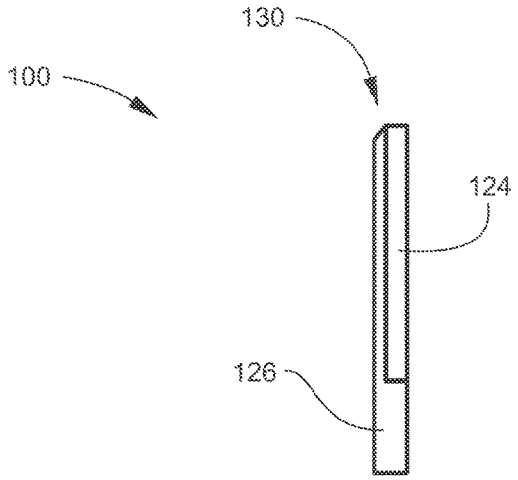
FIG. 4 is a side view of the EGR from FIG. 2.

Input first wire 134, which may be red, was soldered to the center/bottom of the plurality of resistors 118, as shown as left and right electronic components 116L and 116R First output wire 136, which may be black, was soldered to the end of first resistor 118, as shown as right electronic component 116R. Second output wire 138, which may be white, green or the like, may be soldered to the second resistor 118, as shown as left electronic component 116L. Heat shrink tubing 128 was attached to the outside of input wire 134, first output wire 136, and second output wire 138. Tab connectors 132 were attached to the ends of input wire 134, first output wire 136, and second output wire 138. Additional heat shrink tubing 140 was attached to tab connectors 132. As shown in FIG. 4, the resistor side or top of board 124 was covered with an epoxy/potting 126 for protection. The perforated pc board 124 was then dipped into multipurpose rubber coating 130 for weather protection or the like. Potting box 142 was created inside male plug 110 matching the female end in wire harness 102 on engine 108.

Each resistor 118, as shown as left and right electronic components 116L and 116R, were designed carry approximately five volts. When two of said resistors 118 were tied together in series, the voltage changed to approximately 2.5 volts which may be the desired voltage for the present invention to work. Each of resistors 118 used were 10 k ohm ½ watt resistors 120.

The resulting EGR module 100 was used on various 2002 through 2006 Detroit Diesel 12.7 and/or 14.0 liter engines 108. The results showed that engine 108 ran smoother, increased fuel savings from 0.4 tenths of a mile per gallon to 1.5 miles per gallon, and increased power with EGR power module 100 installed. EGR power module 100 stopped turbo hesitations, eliminated surging, missing, coughing, and provided instant throttle response, with lower vibration levels. With EGR power module 100 installed, the various engines 108 ran more like or even better than a pre-EGR engine.

For calculating fuel savings, if a truck operates an annual 100,000 miles a year at 5.0 miles to the gallon, cost would be $85,000.00 per year in fuel at the current fuel cost of $4.25 per gallon. With the 0.4 tenths of a mile per gallon to 1.5 miles per gallon, being conservative and looking at the lower end of the spectrum of 0.4, at 5.4 miles per gallon the costs go down to $78,704.00, or a savings of at least $6,296.00 per year, or at least $121.07 per week.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein, but is limited only by the following claims.

What is claimed is:

1. An exhaust gas recirculation ("EGR") power module configured for a wire harness of an altimetric/barometric pressure sensor of an EGR system for an engine comprising:

a set of wires configured to connect to the wire harness for the altimetric/barometric pressure sensor for the engine, where each wire of the set of wires makes an electrical connection to the wire harness for the altimetric/barometric pressure sensor for the engine; and a circuit connected to said set of wires;

said circuit providing a resistance to the set of wires; said resistance is approximately or equal to 4.8 ohms;

whereby the EGR power module being configured to replace the altimetric/barometric pressure sensor of the EGR system for the engine to maintain an exhaust gas recirculation rate provided by the EGR system at approximately or equal to seven percent without receiving a value from the altimetric/barometric pressure sensor.

2. The EGR power module of claim 1, wherein the wire harness of the altimetric/barometric pressure sensor includes a female plug, wherein the EGR power module further comprising:

a male plug disposed at an end of said set of wires configured to connect to the female plug of the wire harness of the altimetric/barometric pressure sensor, where each wire of the set of wires makes an electrical connection to the wire harness for the altimetric/barometric pressure sensor for the engine through the connection of the male plug of the EGR power module to the female plug of the altimetric/barometric pressure sensor.

* * * * *